US011148159B2

(12) United States Patent
Leibman et al.

(10) Patent No.: US 11,148,159 B2
(45) Date of Patent: Oct. 19, 2021

(54) LAUNDRY CENTER HAVING A RETRACTABLE DISPENSING ASSEMBLY

(71) Applicant: Haier US Appliance Solutions, Inc., Wilmington, DE (US)

(72) Inventors: Alexander B. Leibman, Prospect, KY (US); Wayne E. Lawson, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/454,352

(22) Filed: Jun. 27, 2019

(65) Prior Publication Data

US 2020/0406284 A1 Dec. 31, 2020

(51) Int. Cl.

| | |
|---|---|
| ***D06F 29/00*** | (2006.01) |
| ***D06F 23/04*** | (2006.01) |
| ***B05B 15/60*** | (2018.01) |
| ***B05B 9/01*** | (2006.01) |
| ***B05B 12/00*** | (2018.01) |
| ***B05B 15/70*** | (2018.01) |

(52) U.S. Cl.

CPC ..... *B05B 15/60* (2018.02); *B05B 9/01* (2013.01); *B05B 12/002* (2013.01); *B05B 15/70* (2018.02); *D06F 23/04* (2013.01); *D06F 29/005* (2013.01)

(58) Field of Classification Search

CPC ..... D06F 29/005; D06F 23/04; B05B 15/60; B05B 15/70; B05B 12/002

See application file for complete search history.

(56) References Cited

U.S. PATENT DOCUMENTS

| | | | | |
|---|---|---|---|---|
| 3,238,087 | A | 3/1966 | Norwalk et al. | |
| 3,302,655 | A | 2/1967 | Sasaki | |
| 3,471,065 | A | 10/1969 | Malone | |
| 3,697,420 | A | 10/1972 | Blaisdell et al. | |
| 3,932,151 | A | 1/1976 | Lau | |
| 4,507,942 | A * | 4/1985 | Hirose | D06F 29/00 68/20 |
| 4,821,535 | A * | 4/1989 | Wassilak | D06F 29/00 211/186 |
| 6,277,169 | B1 | 8/2001 | Hampden-Smith et al. | |
| 6,293,121 | B1 | 9/2001 | Labrador | |
| 6,319,469 | B1 | 11/2001 | Mian et al. | |
| 7,562,543 | B2 | 7/2009 | Kendall et al. | |
| 7,761,954 | B2 | 7/2010 | Ziegler | |
| 8,028,829 | B2 | 10/2011 | Arnold et al. | |
| 8,459,067 | B2 | 6/2013 | Kendall et al. | |
| 2002/0170981 | A1 * | 11/2002 | Decker | B05B 1/1636 239/318 |

(Continued)

*Primary Examiner* — Irina Graf

(74) *Attorney, Agent, or Firm* — Dority & Manning, P.A.

(57) ABSTRACT

A laundry center may include a washing machine appliance, a dryer appliance, and a dispensing assembly. The dryer appliance may be vertically-aligned with the washing machine appliance. The dispensing assembly may be disposed between the washing machine appliance and the dryer appliance. The dispensing assembly may include a flexible hose and a dispensing nozzle. The flexible hose may extend between a water supply and a region above the washing machine appliance. The flexible hose may be movable between an extended position and a retracted position. The dispensing nozzle may be fluidly coupled to the flexible hose for selectively dispensing water from the water supply.

19 Claims, 6 Drawing Sheets

(56) References Cited

U.S. PATENT DOCUMENTS

| | | | | |
|---|---|---|---|---|
| 2004/0010848 | A1* | 1/2004 | Esche | E03C 1/04 4/675 |
| 2006/0156763 | A1* | 7/2006 | Vecchi | D06F 19/00 68/3 SS |
| 2016/0102425 | A1* | 4/2016 | Scheckelhoff | D06F 29/00 68/13 R |
| 2018/0142392 | A1* | 5/2018 | Hombroek | D06F 43/002 |
| 2019/0040568 | A1 | 2/2019 | Dunn | |
| 2019/0071814 | A1 | 3/2019 | Leibman | |

* cited by examiner

LAUNDRY CENTER HAVING A RETRACTABLE DISPENSING ASSEMBLY

FIELD OF THE INVENTION

The present subject matter relates generally to laundry assemblies or centers, such as those including both a washing appliance and a dryer appliance.

BACKGROUND OF THE INVENTION

Laundry centers that include one or more modules for washing and drying clothing articles have gained increasing popularity, especially in limited-space environments, such as residential apartment buildings. Typical laundry centers provide a separate washer appliance and dryer appliance, for instance, stacked on top of each other.

Often, the washing machine appliance includes cabinet enclosing a tub for containing water or wash fluid (e.g., water, detergent, bleach, wash additives, etc.). A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

The dryer appliance typically includes a cabinet (e.g., connected to the cabinet of the washing appliance) with a drum mounted therein. In many dryer appliances, a motor rotates the drum during operation of the dryer appliance (e.g., to tumble articles located within a chamber defined by the drum). Alternatively, dryer appliances with fixed drums have been utilized. Air is typically circulated through the drum to facilitate or accelerate the drying of articles therein.

During operation of certain washing machine appliances, a volume of wash fluid is directed into the tub in order to wash or rinse articles within the wash chamber. More specifically, a predetermined volume of wash fluid is typically provided through a stationary nozzle or spout positioned at the center of the back wall of the washing machine appliance. However, in certain situations, a user may wish to direct the flow of wash fluid onto a particular garment (e.g., outside of the wash tub) or within a specific region of the wash tub (e.g., to perform a pretreating operation, to saturate a particular article of clothing, etc.).

Although some users, especially in larger residential areas, are able to have a separate faucet-sink close to a washing machine appliance for treating certain articles or garments, it is often uncommon to have another faucet or water source near the laundry center in a limited-space environment. Moreover, the ability to adjust the amount of wash fluid and its dispensing location is a commercially desirable feature and increases the user's positive perception of the wash process generally.

Accordingly, a laundry center that provides a user with more control over the dispensing of wash fluid is desirable. In particular, a dispensing assembly that enables the dispensing of an additional amount of wash fluid at a variety of desired locations (e.g., within or outside of a wash tub) would be particularly beneficial. Additionally or alternatively, it would be advantageous to provide a dispensing assembly that is movable relative to the of a washing machine or dryer appliance of a laundry center without affecting the usable space or volume of the either appliance.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry center is provided. The laundry center may include a washing machine appliance, a dryer appliance, and a dispensing assembly. The dryer appliance may be vertically-aligned with the washing machine appliance. The dispensing assembly may be disposed between the washing machine appliance and the dryer appliance. The dispensing assembly may include a flexible hose and a dispensing nozzle. The flexible hose may extend between a water supply and a region above the washing machine appliance. The flexible hose may be movable between an extended position and a retracted position. The dispensing nozzle may be fluidly coupled to the flexible hose for selectively dispensing water from the water supply.

In another exemplary aspect of the present disclosure, a laundry center is provided. The laundry center may include a vertical-axis washing machine appliance, a dryer appliance, an intermediate panel, and a dispensing assembly. The dryer appliance may be vertically-aligned with the vertical-axis washing machine appliance. The intermediate panel may extend between the vertical-axis washing machine appliance and the dryer appliance. A recess may be defined rearward through the intermediate panel. The dispensing assembly may be disposed between the vertical-axis washing machine appliance and the dryer appliance. The dispensing assembly may include a flexible hose and a dispensing nozzle. The flexible hose may extend between a water supply and the recess. The flexible hose may be movable through the intermediate panel between an extended position and a retracted position. The dispensing nozzle may be fluidly coupled to the flexible hose for selectively dispensing water from the water supply. The dispensing nozzle may be received within the recess in the retracted position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
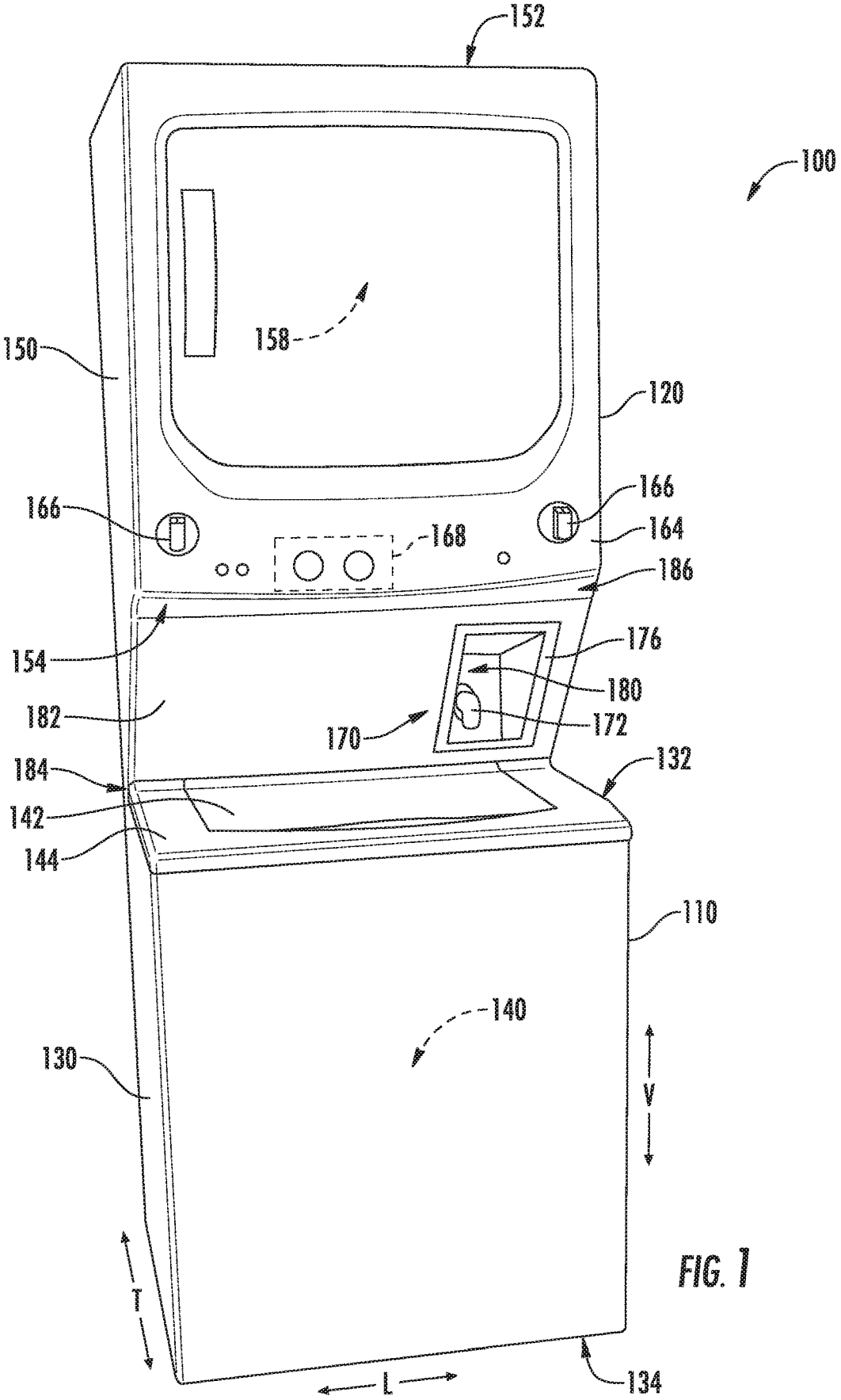
FIG. 1 provides a perspective view of a laundry center according to exemplary embodiments of the present disclosure.
Figure 2:
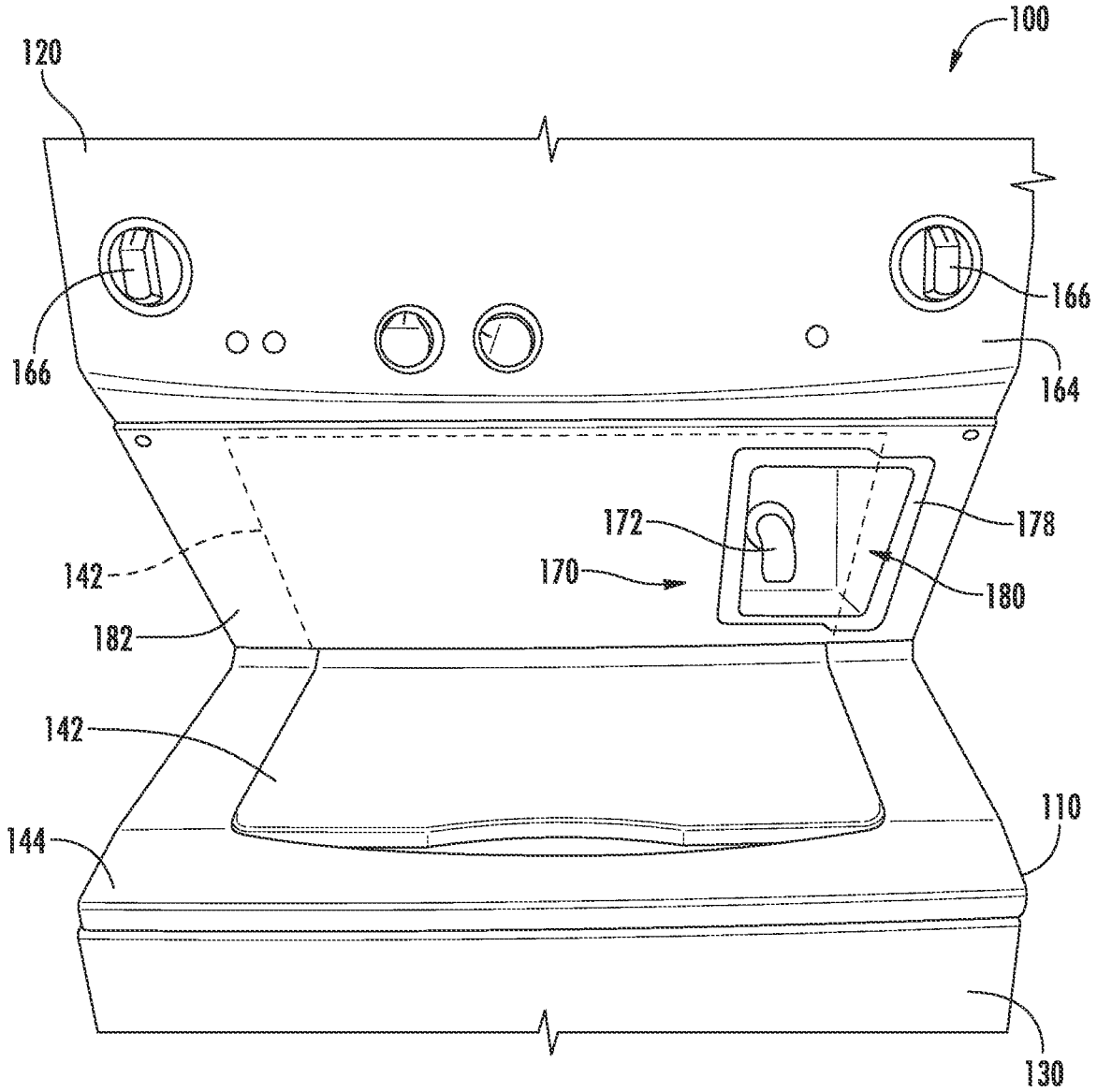
FIG. 2 provides a perspective view of a portion of a laundry assembly including a dispensing assembly according to exemplary embodiments of the present disclosure.
Figure 3:
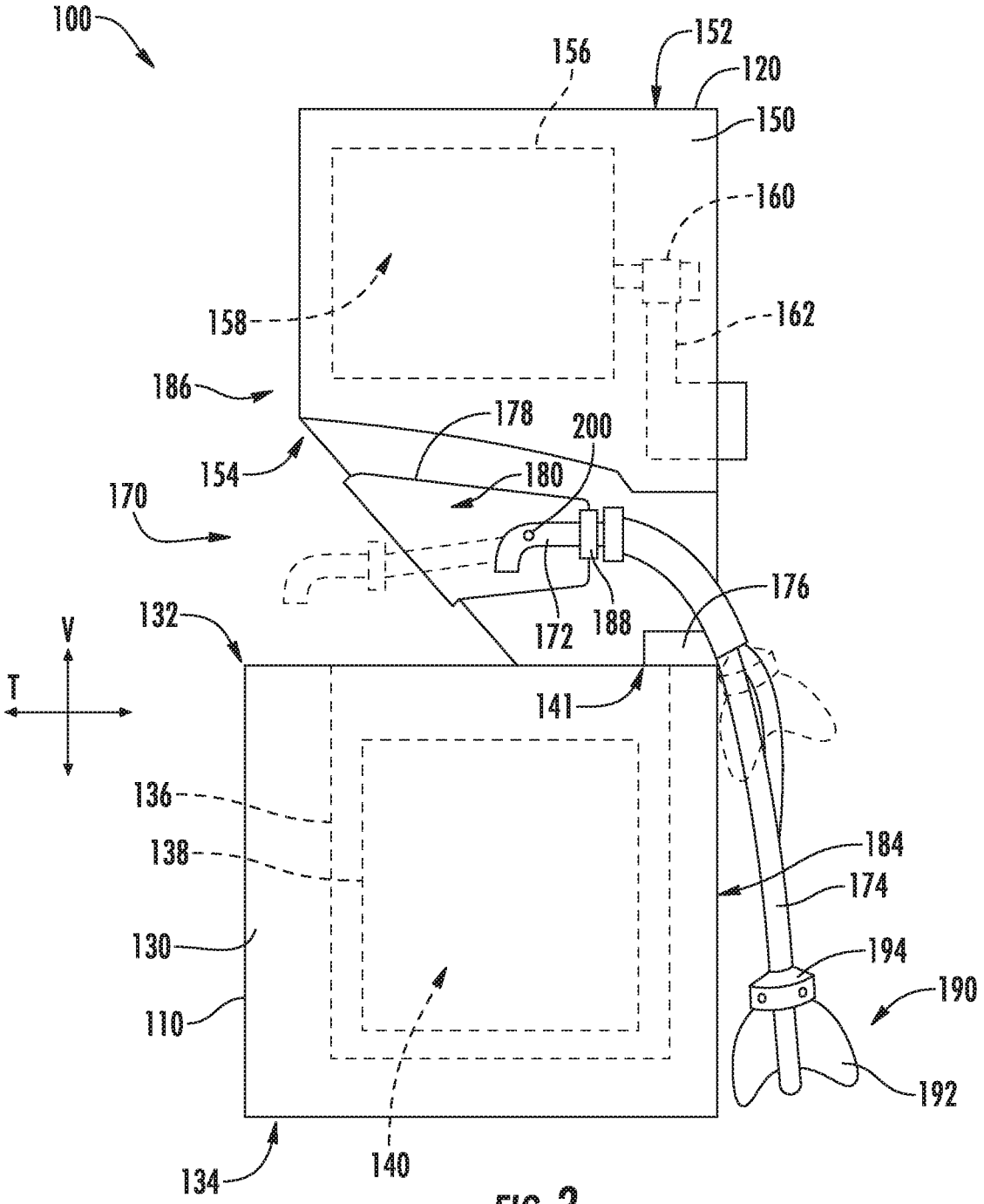
FIG. 3 provides a side elevation view of a laundry center according to exemplary embodiments of the present disclosure.
Figure 4:
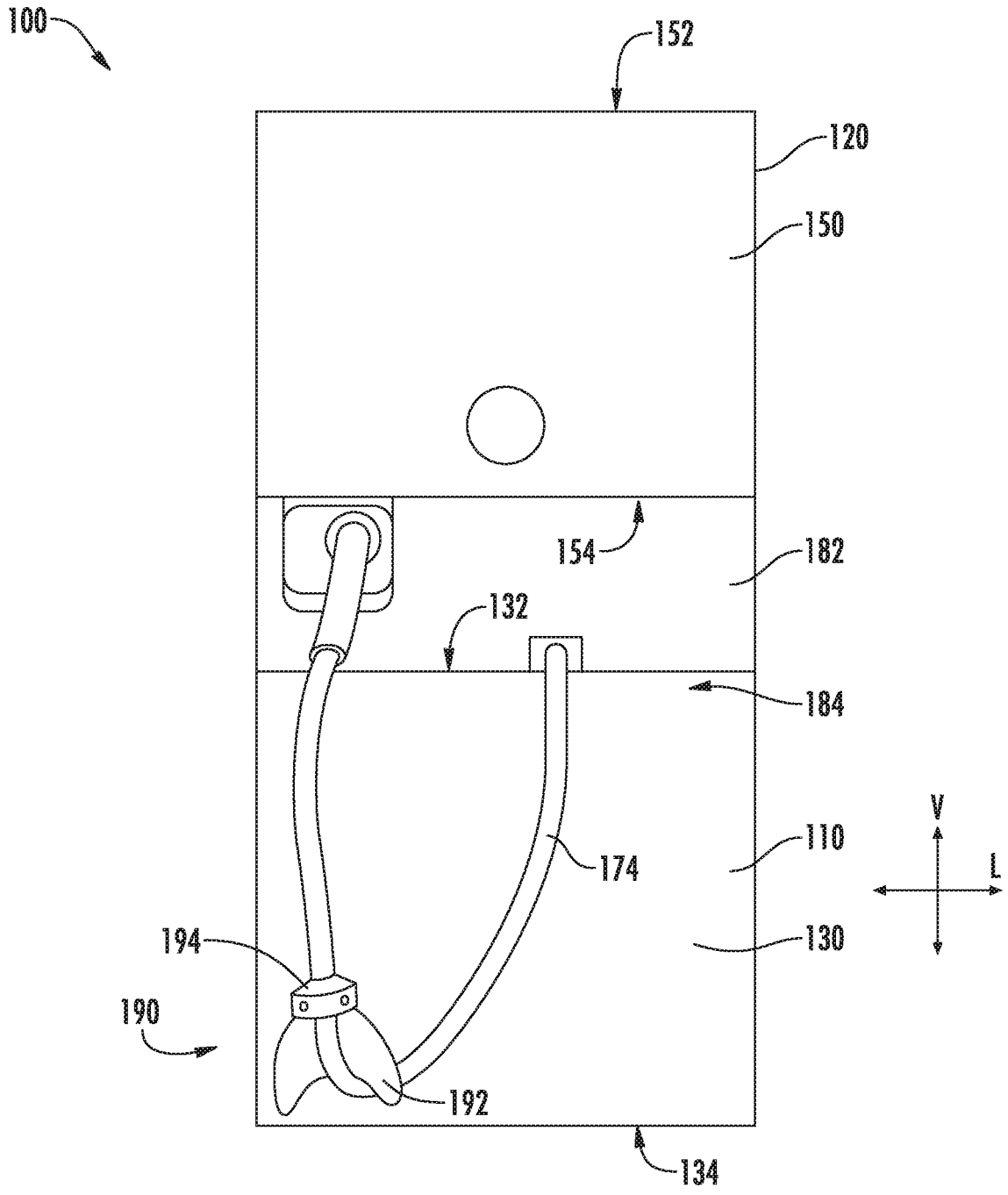
FIG. 4 provides a rear elevation view of a laundry center according to exemplary embodiments of the present disclosure.
Figure 5:
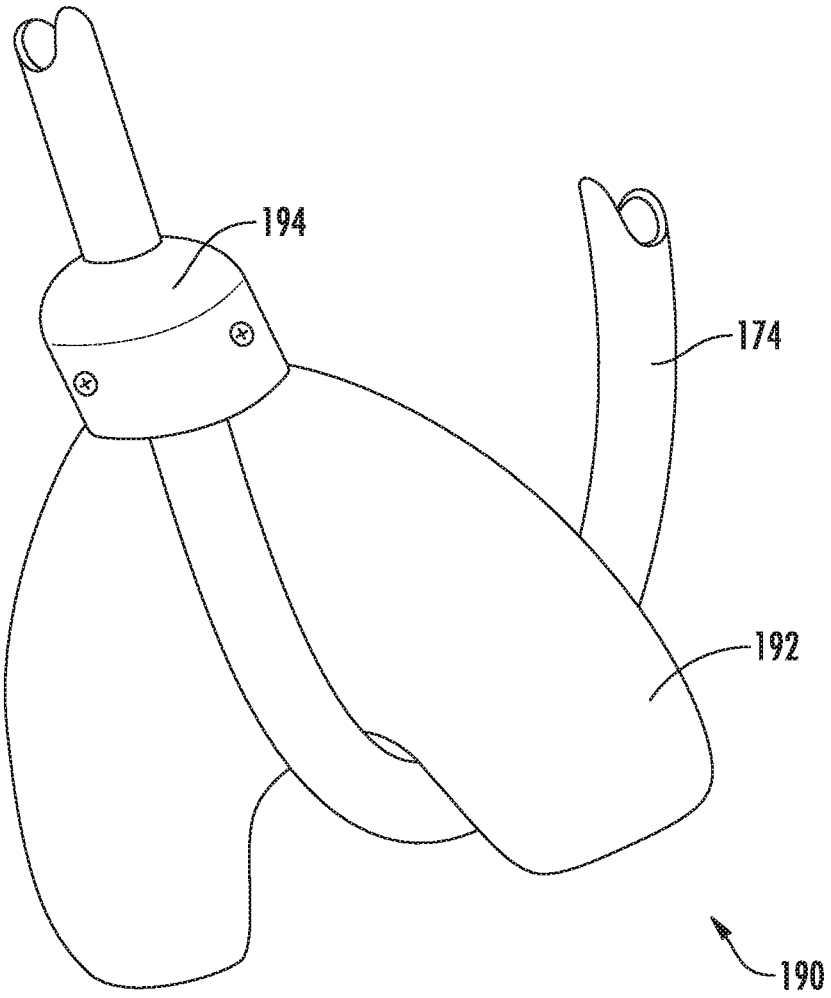
FIG. 5 provides a perspective view of a portion of a laundry assembly including a dispensing assembly according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The term "article" may refer to but need not be limited to fabrics, textiles, garments (or clothing), and linens.

Turning now to the figures, FIGS. 1 through 4 provide various views of a laundry center 100 according to exemplary embodiments of the present disclosure. As shown, laundry center 100 includes a discrete washing machine appliance 110 and dryer appliance 120. When assembled, the laundry center 100 generally defines a vertical direction V, a lateral direction L, and a transverse direction T, each of which is mutually perpendicular, such that an orthogonal coordinate system is defined.

The washing machine appliance 110 may be provided as a vertical-axis or top-loading washing machine. As shown, washing machine appliance 110 has a cabinet 120 that extends between a top portion 132 and a bottom portion 134 along the vertical direction V. A wash basket 138 is rotatably mounted within cabinet 120. A motor (not shown) is in mechanical communication with wash basket 138 to selectively rotate wash basket 138 (e.g., during an agitation cycle or a rinse cycle of washing machine appliance 110). Wash basket 138 is received within a wash tub 136 or wash chamber 140 and is configured for receipt of articles for washing. The wash tub 136 may hold wash fluids for agitation in wash basket 138 within wash tub 136. An agitator or impeller (not shown) extends into wash basket 138 and is also in mechanical communication with the motor. The impeller generally assists agitation of articles disposed within wash basket 138 and may rotate or oscillate during operation of washing machine appliance 110.

A spout 141 for directing water or wash fluid to wash tub 136 (e.g., to chamber 140) is mounted within the cabinet 120 (e.g., at the rear portion thereof below a top panel 144, or at another suitable location). As is generally understood, spout 141 is configured in fluid communication with a water source, such as a municipal water source, (e.g., through a valve assembly 176 mounted to cabinet 120). Optionally, a dispenser box or separate fluid additive dispenser (not shown) may be provided in fluid communication with spout 141 such that fluid additives (e.g., detergent, bleach, etc.) may be mixed with water (e.g., from valve assembly 176) before being dispensed to wash tub 136 or chamber 140.

Cabinet 120 of washing machine appliance 110 generally includes a top panel 144. Top panel 144 defines an opening that permits user access to wash basket 138 of wash tub 136. In some embodiments, lid 142 is rotatably mounted to top panel 144 and permits selective access to the opening. In particular, lid 142 selectively rotates between the closed position shown in FIG. 1 and the open position (e.g., shown in phantom lines at FIG. 2). In the closed position, lid 142 inhibits access to wash basket 138. Conversely, in the open position, a user can access wash basket 138. Lid 142 may also include a handle 132 that, for example, a user may pull or lift when opening and closing lid 142.

Generally, dryer appliance 120 also has a cabinet 150 (e.g., separate from the cabinet 120 of washing machine appliance 110) that extends between a top portion 152 and a bottom portion 154 along the vertical direction V. Optionally, cabinet 150 may be mounted above cabinet 120 and lid 142.

Within cabinet 150 is a drum or container 156. Drum 156 defines a drying chamber 158 for receipt of articles for drying (e.g., after the articles have been washed within washing machine appliance 110). Drum 156 extends between a front portion and a back portion (e.g., along the transverse direction T). In exemplary embodiments the drum 156 is rotational. Alternatively, however, the drum 156 may be fixedly mounted within the cabinet 150.

A motor (not pictured) may be in mechanical communication with a blower or air handler 160 such that the motor rotates a fan (e.g., a centrifugal fan of air handler 160). Air handler 160 is configured for drawing air through chamber 158 of drum 156 (e.g., in order to dry articles located therein). In alternative exemplary embodiments, dryer appliance 120 may include an additional motor (not shown) for rotating fan of air handler 160 independently of drum 156.

Drum 156 may be configured to receive heated air that has been heated by a heater (e.g., in order to dry damp articles disposed within chamber 158 of drum 156). As discussed above, during operation of dryer appliance 120, a motor rotates the fan of air handler 160 such that air handler 160 draws air through chamber 158 of drum 156. Ambient air that is heated by the heater may thus be drawn into chamber 158 of drum 156. Within chamber 158, the heated air can remove moisture (e.g., from damp articles disposed within chamber 158). This internal air in turn flows from the chamber 158 through an outlet assembly 162 positioned within the cabinet 150.

As shown, the dryer appliance 120 is attached to the washing machine appliance 110. For instance, the dryer appliance 120 and the washing machine appliance 110 may be vertically stacked and joined by one or more support brackets and fasteners, as is understood. In some embodiments, the dryer appliance 120 is vertically stacked on top of the washing machine appliance 110. Thus, the washing machine appliance 110 and dryer appliance 120 may be assembled separately before being joined together within laundry center 100.

In certain embodiments, a control panel 164 with at least one input selector 166 is attached to the cabinet 120 or cabinet 150. For example, the control panel 164 may be mounted to cabinet 150 at the bottom portion 154 (e.g., above washing machine appliance 110). Control panel 164 and input selector 166 collectively form a user interface input for operator selection of cycles and features (e.g., of the washing machine appliance 110 and the dryer appliance 120). An optional display of control panel 164 may indicate selected features, operation mode, a countdown timer, or other items of interest to appliance users regarding operation.

Operation of laundry center 100 (e.g., at washing machine appliance 110 or dryer appliance 120) is generally controlled by a controller or processing device 168 that is attached to cabinet 120 or 150 (e.g., at control panel 164) and operatively coupled (e.g., electrically coupled via one or more conductive signal lines, wirelessly coupled via one or more wireless communications bands, etc.) to portions of control panel 164 for user manipulation to select washing machine cycles and features. In response to user manipulation of control panel 164, controller 168 operates the various components of laundry center 100 to execute selected machine cycles and features.

Controller 168 may include a memory (e.g., non-transitive storage media) and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 168 may be constructed without using a microprocessor (e.g., using a combination of discrete analog or digital logic circuitry; such as switches, amplifiers, integrators, comparators, flip-flops, AND gates, and the like) to perform control functionality instead of relying upon software. Control panel 164 and other components of laundry center 100 may be in communication with controller 168 via one or more signal lines or shared communication busses.

Between washing machine appliance 110 and dryer appliance 120, a dispensing assembly 170 is provided. Although the discussion below refers to dispensing assembly 170, one skilled in the art will appreciate that the features and configurations described may be used for other fluid supply assemblies in other laundry centers as well. For example, dispensing assembly 170 may be positioned in another location on or between cabinets 120, 150, may have a different flexible hose 174 configuration, or may dispense any suitable wash fluid or fluids (e.g., water, detergent, other additives, or mixtures thereof). Other variations and modifications of the exemplary embodiments described below are possible, and such variations are contemplated as within the scope of the present disclosure.

As illustrated, dispensing assembly 170 generally includes an extendable nozzle 172 mounted to a retractable flexible hose 174. More specifically, retractable flexible hose 174 provides fluid communication between extendable nozzle 172 and a valve assembly 176. In some embodiments, retractable flexible hose 174 is movable for positioning extendable nozzle 172 in a retracted position (e.g., as shown in solid lines at FIGS. 3 and 4) and an extended position (e.g., as shown in phantom lines at FIG. 3).

Generally, valve assembly 176 is coupled to a supply of water or wash fluid and selectively provides a flow of wash fluid to extendable nozzle 172 so that a user may selectively dispense the wash fluid within wash tub 136. For example, valve assembly 176 (and thus extendable nozzle 172) may be directly coupled to a primary hot and cold water supply (e.g., from a municipal or residential water source). As shown, the valve assembly 176 may be mounted to the cabinet 120 (e.g., in fluid communication with the spout 141).

In some embodiments, a nozzle housing 178 defining a recess 180 (e.g., as an open compartment or chamber) is provided on the laundry center 100. For instance, nozzle housing 178 may be mounted on an intermediate panel 182 that extends between in the washing machine appliance 110 and the dryer appliance 120. Thus, the recess 180 may extend through an intermediate panel 182. In some such embodiments, the intermediate panel 182 extends at an angle (i.e., nonparallel) relative to the vertical direction V between the washing machine appliance 110 and the dryer appliance 120. For instance, the intermediate panel 182 may extend from a rear portion 184 of the washing machine appliance 110 to a front portion 186 of the dryer appliance 120. In contrast to the intermediate panel 182, the recess 180 may generally extend rearward (e.g., along the transverse direction T).

As shown, flexible hose 174 or extendable nozzle 172 may be at least partially positioned or received within the recess 180. For example, when extendable nozzle 172 is in the retracted position, extendable nozzle 172 is positioned within recess 180. In some such embodiments, extendable nozzle 172 may be visible to the user in the retracted position (e.g., while the lid 142 is closed). Optionally, a front collar stop 188 may be coupled to the flexible hose 174 (e.g., behind nozzle 172) and rest against a back or rear portion of the nozzle housing 178. However, when extendable nozzle 172 is pulled out toward the extended position, extendable nozzle 172 and at least a portion of the flexible hose 174 (including rear collar stop 188) are positioned outside the recess 180 of nozzle housing 178 (e.g., above wash tub 136 along the vertical direction V).

In certain embodiments, the nozzle housing 178 and recess 180 are generally positioned rearward from the lid 142. When the lid 142 is moved to the open position, at least a portion of the nozzle 172 or nozzle housing 178 may be covered. Nonetheless, in some such embodiments, the nozzle housing 178 is partially offset (e.g., in the lateral direction L) from the lid 142. Thus, at least the nozzle 172 and flexible hose 174 may be selectively moved to the extended position without forcing the lid 142 closed.

In optional embodiments, dispensing assembly 170 includes a retraction mechanism 190 operably coupled to flexible hose 174 for urging flexible hose 174 toward the retracted position. In this manner, retraction mechanism 190 may be any suitable feature or mechanism configured for drawing flexible hose 174 back into dispenser recess 180. Retraction mechanism 190 may retract flexible hose 174 (e.g., when a user has released the nozzle 172 or a dispensing process is generally finished).

In exemplary embodiments, retraction mechanism 190 includes a weighted anchor 192. In this regard, flexible hose 174 may be a fixed length of hose positioned on or behind cabinet 120 in the retracted position. As shown, weighted anchor 192 may be mounted on or coupled to a bottom of the loop of flexible hose 174 on cabinet 120. As a user pulls dispensing nozzle 172 to the desired location, anchor 192 is moved vertically behind cabinet 120. When a user releases dispensing nozzle 172, anchor 192 urges flexible hose 174 into the retracted position under the force of gravity. Generally, anchor 192 may include any predetermined solid or contained mass sufficient to urge nozzle 172 into the recess 180 (e.g., as motivated by gravity). For instance, anchor 192 may include a flexible or fabric bag filled with a predetermined mass of silica or sand.

In certain embodiments, a rear collar stop 194 is coupled to the flexible hose 174 (e.g., behind the cabinet 120 in support of the weighted anchor 192). For instance, the rear collar stop 194 may move with flexible hose 174 between the retracted position and the extended position. In the extended position, rear collar stop 194 may contact or engage a back-facing portion of nozzle housing 178 such that the flexible hose 174 is prevented from moving forward any further.

Figure 6:
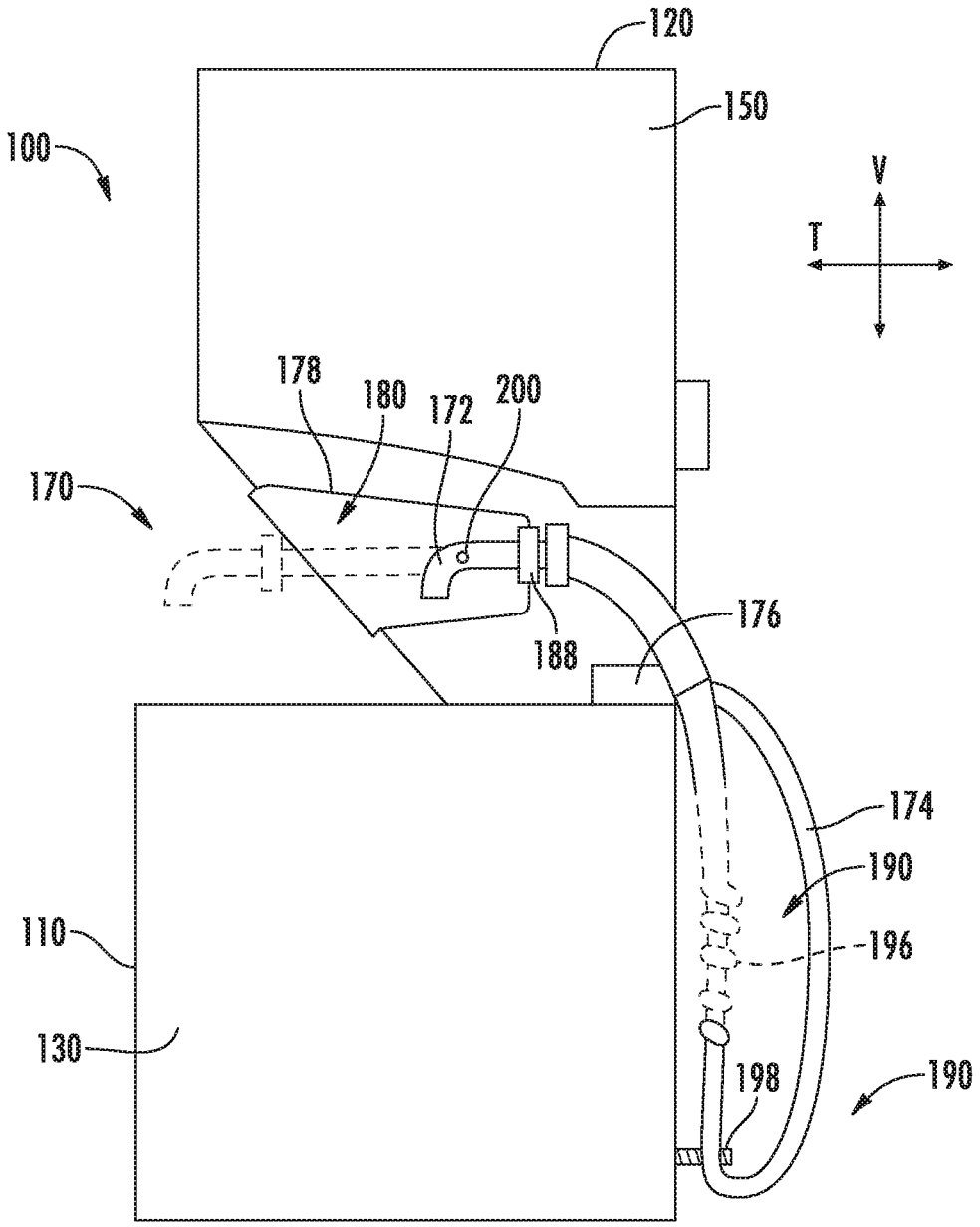
FIG. 6 provides a side elevation view of a laundry center according to other exemplary embodiments of the present disclosure.

Turning briefly to FIG. 6, in additional or alternative embodiments, retraction mechanism 190 includes a resilient coil 196 that generally urges flexible hose 174 into a retracted position and dispensing nozzle 172 back toward a retracted position within the recess 180. Optionally, flexible hose 174 is fixed along the vertical direction V by a positioning clip 194 (e.g., proximate to the bottom portion 134 of cabinet 120). Although clip 194 is illustrated proximal to the bottom 134 (FIG. 1) of cabinet 120, it should be appreciated that clip 194 could alternatively be placed at any other suitable location on cabinet 120 or 150. In the retracted position, a coiled portion of resilient coil 196 of flexible hose 174 is tightly coiled in a retracted position and dispensing nozzle 172 is seated in the recess 180. In operation, a user may pull on dispensing nozzle 172 such that the coiled portion of resilient coil 196 is extended to permit a user to dispense water where desired. After the user is finished using dispensing nozzle 172 for providing water into container, the user may release dispensing nozzle 172 and the resiliency in the coiled portion of resilient coil 196 and flexible hose 174 may draw flexible hose 174 back behind cabinet 120 and into the retracted position. However, according to other alternative embodiments, a mechanical spring may be attached to a fixed location on cabinet 120 and to flexible hose 174 for urging flexible hose 174 toward the retracted position.

Returning now to FIGS. 1 through 4, in some situations, a user may wish to add additional water to wash tub 136 or treat a specific article (e.g., outside of wash tub 136). For example, a user may wish to spot treat one or more articles of clothing. In order to provide a user with control over the flow of wash fluid being dispensed through extendable nozzle 172, dispensing assembly 170 may further include one or more user input buttons 200 for dispensing fluid from nozzle 172. User input buttons 200 may be operably coupled with controller 168 or valve assembly 176 for controlling the flow of water wash fluid. According to the illustrated embodiment, user input button 200 is located on extendable nozzle 172 for easy access by an operator. However, according to alternative embodiments, user input button 200 may be positioned at any other suitable location or locations, such as on control panel 164.

According to an exemplary embodiment, user input buttons 200 are configured for controlling one or more of valve (e.g., of the valve assembly 176 or positioned within the nozzle 172) that can be turned on/off independently or together in any combination. Such valve(s) may be, for example, solenoid valves that are electrically connected to controller 168. However, any other suitable water valve may be used to control the flow of water or wash fluid. Optionally, controller 168 may selectively open and close one or more valves of the valve assembly 176 to allow water or wash fluid to flow from a hot water inlet or a cold water inlet.

User input button 200 may be any button 200 or switch suitable for providing an indication to a valve (e.g., directly or through controller 168) that a particular action should be initiated. For example, buttons 200 may be include one or more button switches, toggle switches, rocker switches, or any other suitable tactile switch, such as capacitive touch buttons. According to the optional embodiments, button 200 includes or is provided as a momentary switch (sometimes referred to as mom-off-mom switch). In this regard, button 200 may be a biased switch that returns to its unlatched or unpressed state when released (e.g., by spring force). In additional or alterative embodiments, at least one button 200 may be directly coupled to a valve positioned in nozzle 172 (e.g., to selectively and mechanically open or close the valve positioned in nozzle 172).

It should be appreciated that the amount of water or wash fluid dispensed from nozzle 172 upon pressing a button 200 may vary depending on the application or wash cycle. Similarly, the amount of water or wash fluid delivered may be preset such that pressing button 200 delivers the predetermined amount of water. Alternatively, one or more valves may be configured to remain open at all times when a corresponding button 200 is depressed. In this manner, a user may precisely control the amount of water dispensed from nozzle 172.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry center comprising:

a washing machine appliance comprising a cabinet, a tub positioned within the cabinet, a wash basket rotatably mounted within the tub, the wash basket defining a wash chamber for receiving articles for washing, and a lid rotatably mounted to the cabinet above the wash basket to move between an open position permitting access to the wash chamber and a closed position restricting access to the wash chamber;

a dryer appliance vertically-aligned with the washing machine appliance; and a dispensing assembly disposed between the washing machine appliance and the dryer appliance, the dispensing assembly comprising a flexible hose extending between a water supply and a region above the washing machine appliance, the flexible hose being movable between an extended position and a retracted position, and a dispensing nozzle fluidly coupled to the flexible hose for selectively dispensing water from the water supply, wherein the laundry center defines a recess located between the washing machine appliance and the dryer appliance along a vertical direction, wherein the recess receives the dispensing nozzle behind the lid in the retracted position, wherein the recess is positioned above the cabinet and behind the lid, the recess being partially covered by and partially offset from the lid in the open position to permit movement of the dispensing nozzle from the recess without forcing the lid to the closed position.

2. The laundry center of claim 1, wherein the dispensing assembly further comprises a valve assembly for regulating a flow of water through the flexible hose and the dispensing nozzle, and a button operably coupled with the valve assembly, the dispensing nozzle being configured for dispensing water when the button is pressed.

3. The laundry center of claim 2, wherein the valve assembly is positioned within the dispensing nozzle or mounted to the washing machine appliance.

4. The laundry center of claim 2, wherein the button is mounted on a control panel of the laundry center or on the dispensing nozzle.

5. The laundry center of claim 1, wherein the dispensing assembly further comprises a retraction mechanism operably coupled to the flexible hose for urging the flexible hose toward the retracted position.

6. The laundry center of claim 5, wherein the retraction mechanism comprises a weighted anchor.

7. The laundry center of claim 5, wherein the retraction mechanism comprises a section of recoil tubing.

8. The laundry center of claim 1 wherein the laundry center further comprises an intermediate panel extending from a rear portion of the washing machine appliance to a front portion of the dryer appliance at a non-parallel angle relative to the vertical direction, and wherein the recess extends rearward through the intermediate panel.

9. A laundry center comprising:

a vertical-axis washing machine appliance comprising a cabinet, a tub positioned within the cabinet, a wash basket rotatably mounted within the tub, the wash basket defining a wash chamber for receiving articles for washing, and a lid rotatably mounted to the cabinet above the wash basket to move between an open position permitting access to the wash chamber and a closed position restricting access to the wash chamber;

a dryer appliance vertically-aligned with the vertical-axis washing machine appliance;

an intermediate panel extending between the vertical-axis washing machine appliance and the dryer appliance, a recess being defined rearward through the intermediate panel; and a dispensing assembly disposed between the vertical-axis washing machine appliance and the dryer appliance, the dispensing assembly comprising a flexible hose extending between a water supply and the recess, the flexible hose being movable through the intermediate panel between an extended position and a retracted position, and a dispensing nozzle fluidly coupled to the flexible hose for selectively dispensing water from the water supply, the dispensing nozzle being received within the recess behind the lid in the retracted position, wherein the recess is positioned above the cabinet and behind the lid, the recess being partially covered by and partially offset from the lid in the open position to permit movement of the dispensing nozzle from the recess without forcing the lid to the closed position.

10. The laundry center of claim 9, wherein the dispensing assembly further comprises a valve assembly for regulating a flow of water through the flexible hose and the dispensing nozzle, and a button that is operably coupled with the valve assembly, the dispensing nozzle being configured for dispensing water when the button is pressed.

11. The laundry center of claim 10, wherein the valve assembly is positioned within the dispensing nozzle or mounted to the vertical-axis washing machine appliance.

12. The laundry center of claim 10, wherein the button is mounted on a control panel of the laundry center or on the dispensing nozzle.

13. The laundry center of claim 9, wherein the dispensing assembly further comprises a retraction mechanism operably coupled to the flexible hose for urging the flexible hose toward the retracted position.

14. The laundry center of claim 13, wherein the retraction mechanism comprises a weighted anchor.

15. The laundry center of claim 13, wherein the retraction mechanism comprises a section of recoil tubing.

16. A laundry center comprising:

a vertical-axis washing machine appliance comprising a cabinet, a tub positioned within the cabinet, a wash basket rotatably mounted within the tub, the wash basket defining a wash chamber for receiving articles for washing, and a lid rotatably mounted to the cabinet above the wash basket to move between an open position permitting access to the wash chamber and a closed position restricting access to the wash chamber;

a dryer appliance vertically-aligned with the vertical-axis washing machine appliance;

an intermediate panel extending between the vertical-axis washing machine appliance and the dryer appliance, a recess being defined rearward through the intermediate panel; and a dispensing assembly disposed between the vertical-axis washing machine appliance and the dryer appliance, the dispensing assembly comprising a flexible hose extending between a water supply and the recess, the flexible hose being movable through the intermediate panel between an extended position and a retracted position, and a dispensing nozzle fluidly coupled to the flexible hose for selectively dispensing water from the water supply, the dispensing nozzle being received within the recess behind the lid in the retracted position, a valve assembly for regulating a flow of water through the flexible hose and the dispensing nozzle, the valve assembly being positioned within the vertical-axis washing machine appliance and a button that is operably coupled with the valve assembly, the dispensing nozzle being configured for dispensing water when the button is pressed, the button being mounted on the dispensing nozzle, wherein the recess is positioned above the cabinet and behind the lid, the recess being partially covered by and partially offset from the lid in the open position to permit movement of the dispensing nozzle from the recess without forcing the lid to the closed position.

17. The laundry center of claim 16, wherein the dispensing assembly further comprises a retraction mechanism operably coupled to the flexible hose for urging the flexible hose toward the retracted position.

18. The laundry center of claim 17, wherein the retraction mechanism comprises a weighted anchor.

19. The laundry center of claim 17, wherein the retraction mechanism comprises a section of recoil tubing.

* * * * *